US006975223B1

(12) United States Patent
Mladen et al.

(10) Patent No.: US 6,975,223 B1
(45) Date of Patent: Dec. 13, 2005

(54) PREMISES PROTECTION SAFETY SYSTEM

(76) Inventors: Petar Mladen, 120 Sutton Ave., FL-2, Stratford, CT (US) 06615-5915; Dobrila Jon Mladen, 120 Sutton Ave., FL-2, Stratford, CT (US) 06615-5915

( * ) Notice: Subject to any disclaimer, the term of this patent is extended or adjusted under 35 U.S.C. 154(b) by 0 days.

(21) Appl. No.: 10/640,948

(22) Filed: Aug. 15, 2003

Related U.S. Application Data

(60) Provisional application No. 60/405,825, filed on Aug. 26, 2002.

(51) Int. Cl.[7] ..... G08B 1/08
(52) U.S. Cl. ..... 340/539.14; 340/825.36; 340/539.1
(58) Field of Search ..... 340/539.1, 539.11, 340/539.14, 825.36, 628, 577, 584, 632

(56) References Cited

U.S. PATENT DOCUMENTS

| | | | | |
|---|---|---|---|---|
| 4,600,314 | A * | 7/1986 | Theriault | 368/10 |
| 5,790,021 | A * | 8/1998 | Mickel et al. | 340/539.32 |
| 6,133,839 | A * | 10/2000 | Ellul et al. | 340/584 |
| 6,172,612 | B1 * | 1/2001 | Odachowski | 340/628 |
| 6,788,197 | B1 * | 9/2004 | Thuillard et al. | 340/522 |

* cited by examiner

*Primary Examiner*—Jeffery Hofsass
*Assistant Examiner*—George Bugg
(74) *Attorney, Agent, or Firm*—Law Office of Leo Zucker

(57) ABSTRACT

Safe-N-Sound premises protection safety system comprises a smoke detector, a remote control and a wall holder. It detects and warns of plurality of life threatening conditions include smoke, fire, and poisonous gases like carbon monoxide. The remote control unit includes control signal to temporarily silence said alarm and the wall mounted remote control housing unit includes remote finder button means operated with radio frequency signals.

11 Claims, 2 Drawing Sheets

Figure 5:
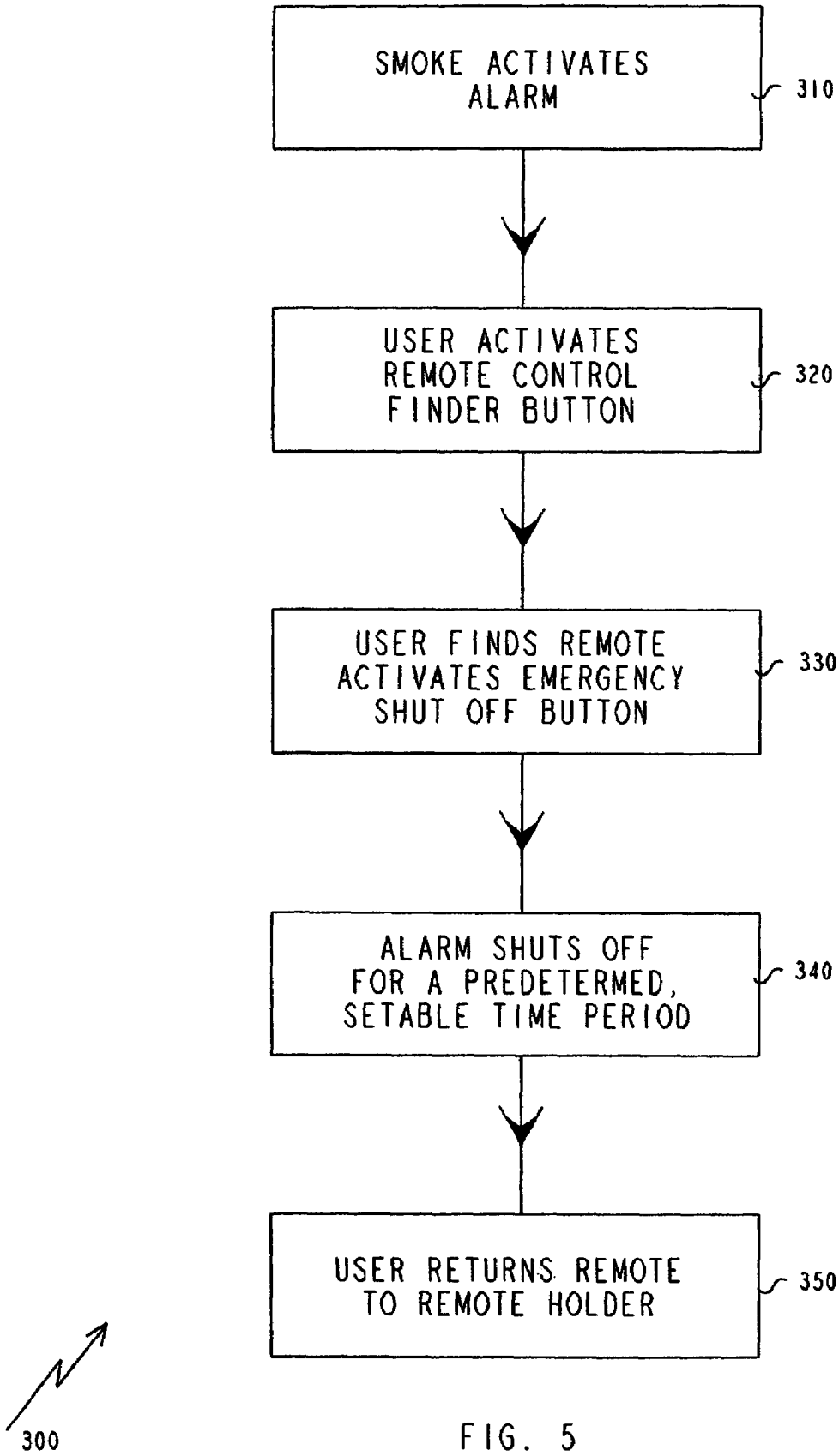

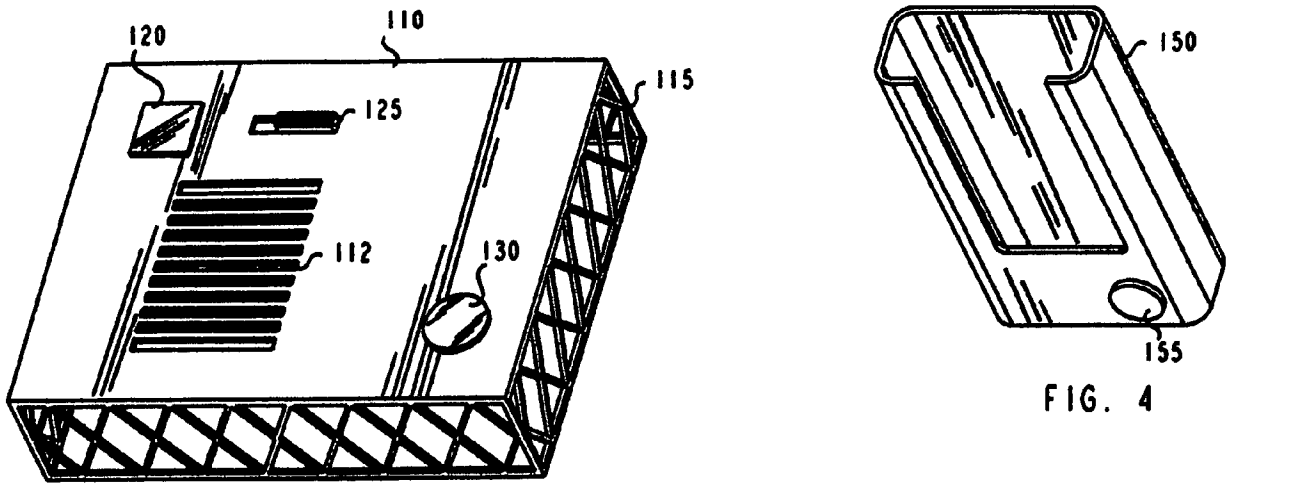
FIG. 1
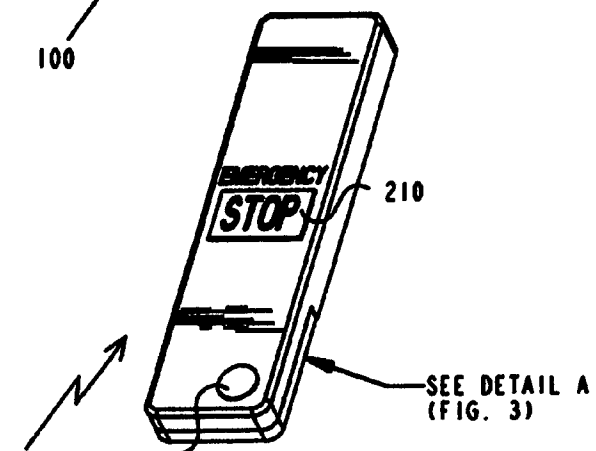
FIG. 2
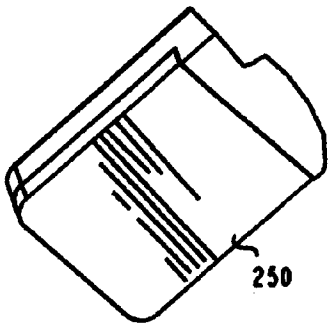
DETAIL A
FIG. 3
FIG. 4

PREMISES PROTECTION SAFETY SYSTEM

RELATED DOCUMENT

This Non-provisional application is based on Provisional Application Ser. 60/405,825 with the same title on Aug. 26, 2002. by the same inventors, who now hereby claim priority there from.

BACKGROUND

This invention relates generally to methods devices and systems for signaling life threatening situations in dwellings and premises of all types. More particularly it relates to detecting fire, smoke, poisonous gases etc and alarming the occupants thereof.

Prior art devices do not provide convenient remote wireless controlled means of silencing the alarm for a variable and resettable predetermined time period. The prior art devices also lack any means of locating the remote controller.

The Problem

The problems with prior art premises protections systems include but are not limited to:

1. They do not warn of full range of dangers.
2. The signals are not bright enough.
3. The signals or alarms cannot be silenced on command.
4. The alarms cannot be conveniently shut off through a remote control
5. They cannot be seen in poor visibility conditions created by smoke etc.
6. Not suitable for multipurpose signaling needs.
7. Cumbersome to make and use.
8. Not cost effective.
9. Not an integrated system solution.

SUMMARY

The Premises Protection Safety System of this invention comprises three components: a smoke detector, a remote controller and silencer and a wall mounted holder.

It detects and warns of plurality of life threatening conditions include smoke, fire, and poisonous gases like carbon monoxide. The remote control unit includes control signal to temporarily silence said alarm and the wall mounted remote control housing unit includes remote finder button means operated with radio frequency signals.

The system includes instructions and easy mounting accessories for the retrofit market. For the OEM market the neon lights can be etched flush with the surface of the mirror. The device of this invention is also known by its trademark name of SAFE-N-Sound.

PRIOR ART

A prior art search was not commissioned because the inventor is intimately familiar with the prior art. Following are typical examples of the prior art know to the applicants.

a) "A Smart Smoke Alarm" Readers Digest" July 2002 Page 202.

b) U.S. Pat. No. 6,384,724 awarded to Andre Landais on May 7, 2002 for "Smoke Alarm"

c) U.S. Pat. No. 6,380,860 presented to Joseph Goetz on Apr. 30, 2002 for "Portable Wireless Cellular Fire Alarm System Apparatus and Method"

d) U.S. Pat. No. 6,362,743 issued to Tanguay et al on Mar. 26, 2002 for "Smoke Alarm with Dual Sensing Technologies and Dual Power Sources:

e) U.S. Design Pat. No. D-453,304 published in the name of Eduard job of Germany on Feb. 5, 2002 for "Smoke Alarm"

f) U.S. Pat. No. 6,150,935 honorably given to Donald Anderson on Nov. 21, 2000 f r "Fire Alarm System with Discrimination Between Smoke and N n-smoke Phenomen n"

g) U.S. Pat. No. 5,889,468 honored upon William Banga on Mar. 30, 1999 for "Extra Security Smoke Alarm System"

h) U.S. Pat. No. 5,745,849 blessed upon Rick Britton on Apr. 28, 1998 for "Combination Cordless Telephone and Premise Monitoring System"

i) U.S. Pat. No. 5,731,759 published in the name of Timothy Finucan on Mar. 24, 1998 for "Combination Flashlight Smoke Detector and Emergency Alarm"

j) U.S. Pat. No. 5,594,422 earned by Huey Jr. et al on Jan. 14, 1997 for "Universaly Accessible Smoke Detector"

k) U.S. Pat. No. 5,422,629 honorably given to David Minnis on Jun. 6, 1995 for "Alarm Silencing Circuitry for Photo-Electric Smoke Detectors"

l) U.S. Pat. No. 5,280,272 showered upon Nagashima et al of Japan on Jan. 18, 1994 for "Fire Alarm system which Distinguishes Between Different Types of Smokes"

m) U.S. Pat. No. 5,186,653 accorded to Normand Robert on Feb. 16, 1993 for "Smoke Alarm Remote Disconnect"

n) U.S. Design Pat. No. D-310,063 conferred upon Willis Cheng of Taipei, Taiwan on Aug. 21, 1990 for "Plug-In Remotely Controlled Switch"

o) U.S. Pat. No. 4,949,077 honorably granted to David Mbuthia on Aug. 14, 1990 for "Portable Unit with Smoke Alarm, Clock Radio, Compass, Retractable Table and Lamp"

p) U.S. Design Pat. No. D-303,223 blessed upon Darrell Issa on Sep. 5, 1989 for "Transmitter Case"

q) U.S. Pat. No. 4,680,576 earned by Fredenck Bauer on Jul. 14, 1987 for "Photoelectric Smoke Detector and Alarm System"

r) U.S. Design Pat. No. D-285,542 granted to Tanaka et al of Japan on Sep. 9, 1986 for "Remote Controller for Mobile Security System"

s) U.S. Pat. No. 4,524,304 honorably presented to Carl Todd on Jun. 18, 1985 for "Smoke Alarm Activated Light"

t) U.S. Pat. No. 4,481,502 printed in the name of Rick Dawson on Nov. 6, 1984 for "Central Smoke Alarm and Annunciator"

u) U.S. Pat. No. 4,313,110 honorably given to Subulak et al n Jan. 26, 1982 f r "Smoke Alarm Having Temporary Disabling Features"

v) U.S. Non-provisional Re-Issue Utility Pat. No. RE-30, 620 again issued to Sweany et al on My 19, 1981 for "High Output Smoke and Heat Detector Alarm System Utilizing A Piezoelectric Transducer and A Voltage Doubling Means"

Unfortunately none of the prior art devices singly or even in combination provide for all of the objectives as established by the inventor for this system as enumerated below.

OBJECTIVES

1. It is an objective of this invention to provide methods devices and systems for ensuring the safety of all types of premises and dwellings.

2. Another objective of this invention is to provide a signaling system that can be easily mounted.

3. Another objective of this invention is to provide indicators so bright that they are easily visible in conditions of poor visibility.

4. Another objective of this invention is to provide a system that is powered by the power source of the dwelling.

5. Another objective of this invention is that its design is easy, simple and elegant.

6. Another objective of this invention is to provide a system that it detects and warns of all types of life threatening situations including fire, smoke, poisonous gases etc.

7. Another objective of this invention is that it be capable of multiple uses.

8. Another objective of this invention is that it's use is such that it does not require any additional training.

9. Another objective of this invention is that it can be adopted for OEM as well as retrofit markets.

10. Another objective of this invention is that it meet all federal, state, local and other private standards guidelines, regulations and recommendations with respect to safety, environment, energy consumption.

11 Another objective of this invention is that it can be made from modular standard materials, and components that are also easily maintainable.

12. Another objective of this invention is that its alarm can be promptly and easily silenced for a predetermined period of time.

13. Another objective of this invention is that the alarm can be silenced remotely through a standard remote controller.

14. Another objective of this invention is that it provides a holder for its remote controller at a fixed place strategically located near the smoke alarm detector.

15. Another objective of this invention is that the remote holder has communications means to quickly locate the remote controller in the unlikely event it is not there.

Other objectives of this invention reside in its simplicity, elegance of design, ease of manufacture, service and nse and even aesthetics as will become apparent from the following brief description of the drawings and the detailed description of the concept embodiment.

BRIEF DESCRIPTION OF THE DRAWINGS a) FIG. 1 is an isometric 3 D view of the sensor box.

b) FIG. 2 is an isometric 3 D view of the remote controller.

c) FIG. 3 shows 3 D Isometric detailed view of the batter compartment of the remote controller.

d) FIG. 4 shows an isometric 3 D view of the remote controller holder.

e) FIG. 5 shows flow-chart of the underling algorithmic steps.

DETAILED DESCRIPTION OF THE BEST MODE PREFERRED EMBODIMENT

As shown in the drawings wherein like numerals represent like parts throughout the several views, there is generally disclosed in FIG. 1 is safety signaling system of this invention wherein FIG. 1 is an isometric 3 D view of the sensor box 110, complete with access grills 112, 115, flashing red alarm light 120, and alarm test button 130.

FIG. 2 is an isometric 3 D view of the remote controller 200 complete with emergency stop push button 210, an alarm speaker 220 and a battery compartment 250.

FIG. 3 shows 3 D Isometric detailed view of the battery compartment 250 of the remote controller 200.

FIG. 4 shows an isometric 3 D view of the remote controller holder 150 complete with remote controller locator radio button 155.

FIG. 5 shows flow-chart 300 of the underlying algorithmic steps including the following steps.

a) The process step 310 wherein smoke activates alarm.

b) The process step 320 wherein user activates remote control locator button 320 c) The process step 330 whereby user finds remote 200 and activates emergency shut off button 210 d) The process step 340 wherein alarm 120 is shut off for a pre-determined settable time.

e) The algorithmic step 350 whereby user returns remote controller 200 to Remote Holder 150.

The inventor envisions that the smoke detector would be equipped with a housing made from plastic, heavy rubber or fiberglass, a radio receiver and an infrared receiver.

Other features would include a microchip, a battery compartment, a carbon monoxide detector and a metal antenna. The smoke detector would be round in shape. It would measure two inches in diameter and one and a half inches in height and would be rectangular in shape. It would measure three inches in length, two inches in width and one-fourth of an inch to two inches in height.

The remote control would have a housing made from plastic, rubber or fiberglass, a battery compartment, a red stop button, an emergency button, a radio receiver and a radio transmitter. Other features would include an infrared transmitter, a microchip, plastic on/off buttons, a loudspeaker and a metal antenna.

The wall holder would also be made from plastic or fiberglass. It would have a green glow-in-the dark button, a battery compartment, a radio transmitter and a metal antenna. Pressing the bufton on the wall holder would send a signal to the remote control, which would begin beeping so that it could be found easily in an emergency situation.

The plastic components of Safe-N-Sound could be produced from PVC, ABS or polycarbonate plastic. These plastics would be suitable for use with Safe-N-Sound, since they would be durable, strong, lightweight and relatively inexpensive to use. The rubber components of Safe-N-Sound- could be created from butadiene or sorbothane rubber. These materials would be durable and could be easily molded into the desired form.

To create the glow-in-the-dark effect for the button on the wall holder, the plastic used to form the button could have light-emitting metallic salts added to the plastic prior to molding. Examples of possible compounds would be calcium tungstate, zinc sulfide and zinc silicate.

Depending upon the chemical compound employed and the nature of the plastic used, the glow may be a bluish-white, greenish-white or yellowish color. The plastic components of Safe-N-Sound could be formed with the use of injection molding or blow molding. Injection molding is a process that has been in use since the 1920s and provides a versatility almost unmatched in the mass production of any material. It requires that melted plastic be forcefully injected into relatively cool molds. As the plastic begins to harden, it takes on the shape of the mold cavity and, when cool, requires few post molding operations. Other advantages of this process include its speed of production and the ability to simultaneously manufacture multiple parts.

Blow molding in the production of plastic shapes is a form of extrusion, a major technique in the plastics industry. Extrusion is used to push a molten tube, called a parison, into a bottle-shaped mold. Compressed air then forces the parison against the cold walls of the mold, hence the term "blow molding". Molds are generally side fed, with the thickness controlled by a tapered mandrel (core) or a variable-orifice die. Continuous extrusion is possible by the use of multiple blow molds. Potential problems that might arise during the development of Safe-N-Sound should be amenable to resolution through normal product testing and refinement processes, after which we would anticipate the product could be produced routinely. However, we also recommend that an interested company should be allowed to do their own form of testing and marketing and to provide modification suggestions.

The smoke detector could be in the form of an optical detector that would use a light beam and a light sensor that would react to anything obscuring the beam. Another possible option would be to use an ionizing smoke detector.

This type of smoke detector would have a chamber in which a low electric current flows through the air. Any smoke particles that entered the chamber would increase the electrical resistance inside the chamber, causing less current to flow and activating a microchip which would turn on the alarm.

Assembly Use and Operation

The manufacturing, assembly and use of this invention is very simple even intuitive. Nonetheless the inventor suggests the following procedure.

Note: For the DIY and retrofit after market, mounting hardware such as Nails, screws and double sided sticky tape are included to facilitate easy installation of the signaling member on the mirrors.

To use the system, one would install the smoke detector. When the smoke detector detected the presence of smoke or carbon monoxide, it would sound an alarm. If the remote control was not used to shut off the alarm signal within 30 seconds, a second alarm signal would be transmitted to a nearby fire station or to other rescue services.

The applicant has described the essence of this invention. While this invention has been described with reference to an illustrative embodiment, this description is not intended to be construed in a limiting sense. Various modifications and combinations of the illustrative embodiments as well as other embodiments of the invention will be apparent to a person of average skill in the art upon reference to this description.

Due to the simplicity and elegance of the design of this invention designing around it is very difficult if not impossible. Nonetheless many changes may be made to this design without deviating from the spirit of this invention. Examples of such contemplated variations include the following:

1. The brightness, shape and size and type of the indicators may be varied.
2. The mounting method may be further simplified.
3. Additional sensors for other potentially unsafe conditions may be added.
4. The interface to the remote controller may be modified.
5. The power source may be changed.
6. A controller for adjusting the brightness and or loudness may be incorporated.
7. Additional complimentary and complementary functions and features may be added.
8. Other accessories may be added.
9. Other changes such as aesthetics and substitution of newer materials as they become available, which substantially perform the same function in substantially the same manner with substantially the same result without deviating from the spirit of the invention may be made.

Following is a listing of the components used in the best mode preferred embodiment and the alternate embodiments for use with OEM as well as retrofit markets For the ready reference of the reader the reference numerals have been arranged in ascending numerical order.

| | |
|---|---|
| 99 = | Dwelling or the premises generally |
| 100 = | Main detector system unit generally |
| 110 = | Housing for the detectors and electronics for signal sensing and processing |
| 112 = | Access grill |
| 115 = | Co detection access grill |
| 120 = | Flashing alarm indicator |
| 125 = | Light indicator on-off slide switch (Optional) |
| 130 = | Test button |
| 150 = | Holder for Remote Controller |
| 155 = | Remote controller locator switch |
| 200 = | Remote controller generally |
| 210 = | Emergency stop push button |
| 220 = | Small alarm speaker |
| 250 = | Battery Compartment in Remote Controller |
| 300 = | Protocol flowchart showing the algorithmic process steps |
| 310 = | Smoke activates alarm |
| 320 = | User activates remote control locator button |
| 330 = | User finds remote and activates emergency shut off button |
| 340 = | Alarm hut off for a pre-determined settable time |
| 350 = | user returns remote controller to Remote Holder. |

Definitions and Acronyms

A great care has been taken to use words with their conventional dictionary definitions. Following definitions are included here for clarification.

| | |
|---|---|
| 3D = | Three Dimensional |
| DIY = | Do It Yourself |
| Integrated = | Combination of two entities to act like one |
| Interface = | Junction between two dissimilar entities |
| OEM = | Original Equipment Manufacturer |
| System = | Synergistic cooperation of components |

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefore contemplated that the appended claim(s) cover any such modifications, embodiments as fall within the true scope of this invention.

What is claimed is:

1. A premises protection safety system, comprising:

a detector unit constructed and arranged to detect one or more life-threatening conditions and to output a corresponding activation signal;

an alarm device coupled to the detector unit and having an associated first receiver operative to detect a control signal for disabling the alarm device for a predetermined time interval after the alarm device responds to the activation signal from the detector unit;

a remote control unit constructed and arranged for controlling the detector unit from a remote location; and a remote control housing assembly constructed and arranged for holding the remote control unit;

wherein the remote control unit includes:

a first transmitter operative to produce the control signal for disabling the alarm device in response to a command by a user, and a second receiver operative to produce an audible sound in response to a remote finder signal so that the user can locate the remote control unit if removed from the remote control housing; and the remote control housing assembly includes a second transmitter operative to produce the remote finder signal in response to a command by the user.

2. The premises protection safety system of claim 1, wherein the life threatening conditions include smoke, fire, and poisonous gases including carbon monoxide.

3. The premises protection safety system of claim 1, wherein the alarm device is constructed and arranged to transmit an alarm signal to an emergency response facility in the absence of the control signal from the remote control unit for a certain time period after the alarm device responds to the activation signal from the detector unit.

4. The premises protection safety system of claim 3, wherein the certain time period is about 30 seconds.

5. The premises protection safety system of claim 1, wherein the first receiver associated with the alarm device is configured so that the time interval during which the alarm device is disabled by the control signal from the remote control unit is setable by the user.

6. The premises protection safety system of claim 1, wherein the remote control housing assembly has an associated button for activating the second transmitter of the assembly to produce the remote finder signal.

7. The premises protection safety system of claim 6, wherein the housing assembly button is formed with a light-emitting material so that the button is visible to the user in a dark environment.

8. A premises protection safety system, comprising:

a detector unit constructed and arranged to detect one or more life-threatening conditions and to output a corresponding activation signal;

an alarm device coupled to the detector unit and having an associated receiver operative to detect a control signal for disabling the alarm device for a predetermined time interval after the alarm device responds to the activation signal from the detector unit; and a portable remote control unit constructed and arranged for controlling the detector unit from a remote location;

wherein the remote control unit includes a transmitter operative to produce the control signal for disabling the alarm device in response to a command by a user; and the receiver associated with the alarm device is configured so that the time interval during which the alarm device is disabled by the control signal from the remote control unit is setable by the user.

9. The premises protection safety system of claim 8, wherein the life threatening conditions include smoke, fire, and poisonous gases including carbon monoxide.

10. The premises protection safety system of claim 8, wherein the alarm device is constructed and arranged to transmit an alarm signal to an emergency response facility in the absence of the control signal from the remote control unit for a certain time period after the alarm device responds to the activation signal from the detector unit.

11. The premises protection safety system of claim 10, wherein the certain time period is about 30 seconds.

* * * * *